US010919686B2

(12) United States Patent
Chivrac et al.

(10) Patent No.: US 10,919,686 B2
(45) Date of Patent: Feb. 16, 2021

(54) PLASTIC CONTAINER FOR FOOD PRODUCT HAVING A PLURALITY OF FRANGIBLE VENT HOLES

(71) Applicant: COMPAGNIE GERVAIS DANONE, Paris (FR)

(72) Inventors: Frederic Chivrac, Paris (FR); Pedro Galera Sanchez, Ibi (ES)

(73) Assignee: COMPAGNIE GERVAIS DANONE, Paris (FR)

( * ) Notice: Subject to any disclaimer, the term of this patent is extended or adjusted under 35 U.S.C. 154(b) by 0 days.

(21) Appl. No.: 15/531,278

(22) PCT Filed: Nov. 27, 2014

(86) PCT No.: PCT/IB2014/002735
§ 371 (c)(1),
(2) Date: May 26, 2017

(87) PCT Pub. No.: WO2016/083859
PCT Pub. Date: Jun. 2, 2016

(65) Prior Publication Data

US 2017/0355510 A1 Dec. 14, 2017

(51) Int. Cl.
*B65D 83/00* (2006.01)
*B65D 85/72* (2006.01)
(Continued)

(52) U.S. Cl.
CPC ..... *B65D 83/0055* (2013.01); *B65D 25/38* (2013.01); *B65D 77/22* (2013.01);
(Continued)

(58) Field of Classification Search
CPC ..... B65D 83/0055; B65D 83/0005; B65D 85/72; B65D 85/80; B65D 85/78;
(Continued)

(56) References Cited

U.S. PATENT DOCUMENTS 3,432,027 A * 3/1969 Mueller ..... A23G 9/287 206/527
4,154,345 A 5/1979 Davis et al.

FOREIGN PATENT DOCUMENTS

DE 20 2011 001219 U1 4/2011
FR 2 718 413 A5 10/1995
(Continued)

OTHER PUBLICATIONS

Human Translation of Linard FR 2719828. (Year: 1995).*
International Search Report, dated Jul. 27, 2015, from corresponding PCT application.

*Primary Examiner* — Ericson M Lachica
(74) *Attorney, Agent, or Firm* — Nixon & Vanderhye

(57) ABSTRACT

The plastic container for a molded food product is provided with a hollow body, a bottom and a discharge opening. Frangible connections are distributed in the bottom and thus several distinct bottom regions each including at least one of the frangible connections are defined. A plastic actuating member that is movable relative to the bottom outer edge is configured to actuate simultaneous break of each of the frangible connections, so as to form at least three spaced vent holes in the bottom. The vent holes are arranged around the single actuation portion of the actuating member. Food product can be easily released as one block through the opening, after the container has been unsealed and turned upside down.

18 Claims, 5 Drawing Sheets

(51) Int. Cl.
*B65D 25/38* (2006.01)
*B65D 77/22* (2006.01)

(52) U.S. Cl.
CPC ..... *B65D 83/0005* (2013.01); *B65D 85/72* (2013.01); *B65D 2231/027* (2013.01)

(58) Field of Classification Search
CPC ..... B65D 77/22; B65D 25/38; B65D 83/055; B65D 2231/027; B65B 29/02; A47G 19/23; A21B 3/18
See application file for complete search history.

(56) References Cited

FOREIGN PATENT DOCUMENTS

| | | | | |
|---|---|---|---|---|
| FR | 2 719 828 A1 | | 11/1995 | |
| FR | 2719828 A1 | * | 11/1995 | ..... B65D 85/72 |

* cited by examiner

PLASTIC CONTAINER FOR FOOD PRODUCT HAVING A PLURALITY OF FRANGIBLE VENT HOLES

BACKGROUND THE INVENTION

Field of the Invention

The present invention generally relates to containers used in food packaging industry, particularly to thermoformed plastic containers, such as pots for dairy products, for instance creams or custard-like products which have been set, thus having a certain consistency.

Description of Related Art

To consume such products, especially creams which have been set, so-called cream caramels, or similar food products having a firm texture, it is preferable to release them from the container, which makes them easier to consume and more appetizing, especially if the container in which they have been molded has beforehand been lined with caramel or similar sweet taste substance in accordance with a known technique. However, performing this release from the container through the wide mouth presents certain manipulative difficulties and the shape of semi solid or solid molded food can be spoiled.

In the case of industrial production, especially using thin-walled disposable packages, it is known that the release from the mould can be facilitated by piercing the bottom of the container, after it has been turned upside down, by tearing a removable tab, as shown for instance in the document FR 2 178 413. Use of caramel also facilitates the release and correct detachment from the bottom.

Forming an air entry in the bottom facilitates releasing operations, only by gravity effect, and the mass may be possibly covered by a topping (caramel or liquid jam for instance) initially contained in the bottom part of the container. However, for some molded food products, the user often has to wait almost one minute for the release. Additionally, the bubble of air formed by air entry often causes deformation of the food mass.

SUMMARY OF THE INVENTION

The purpose of the present invention is to provide containers efficient for releasing a mass of food product without spoiling its shape while at the same time having a user friendly actuation to obtain such efficiency.

To this end, embodiments of the present invention provide a cup-like plastic container for a molded food product, comprising a bottom, a side wall tightly connected to the bottom, so as to define an interior volume of the container, and an opening at the opposite from the bottom, wherein the bottom comprises:

- an outer edge;
- frangible connections, distributed so that the bottom comprises at least three distinct regions each comprising at least one of the frangible connections;

and wherein the container further comprises a plastic actuating member that is movable relative to the outer edge and is configured to actuate simultaneous break of each of the frangible connections and form at least three spaced vent holes in the bottom.

The fact that three or more spaced vent holes are formed in the bottom is advantageous to keep the shape of the molded food product. It has also been observed that the time sufficient for the sliding decrease significantly when three or more spaced vent holes are formed. The three distinct regions may define angular sectors of the bottom, distributed around a longitudinal axis of the container. The container is thus user-friendly and simultaneous break of frangible connections is advantageous to control air entry inside the interior volume at the bottom side. With such distribution of the vent holes, distinct air bubbles can be formed rather than one single central air bubble. Air pushing of the product is performed according to a controlled longitudinal direction. It has been observed that forming a single bubble through a single vent hole does not allow such an efficient control.

Optionally, the frangible connections are unaligned and there exits for the side wall at least one virtual median plane that intersects the bottom between two bottom halves, with the provision that the vent holes are distributed in the two bottom halves, at a distance from the virtual median plane. With such arrangement, air entering through the bottom does not accumulate in a single place and deformation of the product is prevented.

To better preventing deformation, each of the vent holes are laterally shifted relative to the longitudinal axis of the container. With vent holes arranged close to the outer edge of the bottom, the shape of the product at the bottom side remains unchanged or not significantly altered. When the opening is facing downwardly, after the actuating member has been displaced, the molded food product is replaced by air entering through the spaced vent holes. Such food product is discharged according to a controlled direction (vertical direction coinciding with gravity effect), so that it is released substantially vertically as one single block through the opening (no side falling before another side of the food product).

In one embodiment, the bottom may be defined by a single layer of plastic material and the actuating member essentially comprises the same plastic material as for this single layer of the bottom. Such containers can be produced for highly competitive markets, using processes that reduce the unit cost of each packaging, especially when the actuating member, the bottom and the side wall are formed by injection molding of the same plastic.

In various embodiments of the container of the invention, recourse may optionally also be had to one or more of the following dispositions:

- the opening defines a determined virtual plane and the actuating member extends parallel to the determined virtual plane before and after actuation of the actuating member to break each of the frangible connections (the configuration of the actuating member is predefined in the actuated state, so as to ensure accurate opening of all the vent holes, simultaneously).
- the bottom is provided with closing members, a peripheral part that comprises the outer edge, and a plurality of intermediary wall parts joining the peripheral part; with the provision that the frangible connections each separate one of the closing members from one of the intermediary wall parts, wherein the actuating member is configured to actuate simultaneously a relative change of position between the closing members and the plurality of intermediary wall parts of the bottom, whereby simultaneous break of each of the frangible connections is obtained (the frangible connections do not need to form large areas and can rather form lines of weakness; such arrangement is of interest to prevent accidental opening of the bottom).
- the actuating member comprises an actuation portion and the closing members defined as rigid protrusions with respect to the actuation portion (typically radial protrusions). This configuration is useful to avoid use of a cutting tool to define the frangible connections; typically by using a hinge-effect or similar deformation, frangible lines can be broken easily when the rigid protrusions are simultaneously displaced.

the closing members are rigid protrusions fixed relative to the outer edge and extending from the peripheral part to an end adjacent to the actuating member. This other configuration is also useful to avoid use of cutting tool to define the frangible connections.

the actuating member is integral part of the bottom and is surrounded by the plurality of intermediary wall parts.

the actuating member provided with an actuation portion is connected to the peripheral part by a plastic hinge and configured as a cam to rotate the intermediary wall parts by a movement of the actuation portion parallel to (along) a longitudinal axis of the container.

the intermediary wall parts are sloped inward from the peripheral part in an actuated state of the actuating member.

the vent holes are each configured between two adjacent of said intermediary parts to guide air toward a periphery of the interior volume (an air guiding effect toward the interior face of the side wall is advantageously obtained, thus preventing excess of pressure in a top part of the product to be poured).

the actuating member comprises an actuation portion configured as a push button in the bottom and the bottom has a dome shape in an actuated position of the actuating member (such configuration makes the actuation operation simple with a direct push).

in said actuated position, the actuation portion defines an apex of the dome, while the vent holes are provided in a tapered annular wall part of the dome.

at least three of the closing members are provided in the bottom, which are preferably regularly spaced, and wherein the following relation is satisfied:

$$\frac{1}{3} \leq d8/d3 \leq \frac{2}{3}$$

d3 being a characteristic size of the bottom chosen amongst a diameter and a length, and d8 being the shortest distance between two of the closing members.

the actuating member is integral with the bottom or irremovably attached to the bottom after actuation of the actuating member.

the outer extends at a free end of the container, the bottom comprises an annular groove defined between the outer edge and the actuating member, and the frangible connections extend in the groove (with such arrangement in a groove of the bottom, the frangible connections cannot be accidentally broken).

the side wall extends annularly around a longitudinal axis of the container, the vent holes being each distal from the longitudinal axis and proximal relative to the outer edge, the longitudinal axis preferably intersecting the actuating member (better efficiency is thus obtained to simultaneously break the frangible connections, while minimizing the material used to form the actuating member).

the frangible connections are curved or angled, and preferably provided with one of a V-shape, a L-shape, a U-shape, a C-shape and a J-shape (vent holes having a generally triangular shape may be obtained, such shape being particularly efficient for obtaining simultaneously opening of relatively wide holes by a single actuating member; here the term "angled" excludes rectilinear slits or similar narrow holes having two parallel long sides).

the actuating member comprises a plurality of piercing elements according to a same distribution as the frangible connections and the actuating member is movable relative to the outer edge to simultaneously break the frangible connections by the piercing elements.

The empty recipient, defined by a plastic or thermoplastic hollow body (starting recipient that can be filled with food composition), used for such process is provided with an upper opening and comprises the hollow body which defines a single cavity of the container. The upper end of the recipient (which defines the upper opening) is preferably flanged. The container forms part of a sealed packaging and the interior volume of the container is a single filling volume extending as far as the bottom. It is thus understood that the container according to the invention is used to contain a molded mass of a solid or semi solid dairy product.

Other features and advantages of the invention will become apparent to those skilled in the art during the description which will follow, given by way of a non-limiting example, with reference to the appended drawings.

DETAILED DESCRIPTION OF EMBODIMENTS

In the various figures, the same references are used to designate identical or similar elements.

Figure 1:
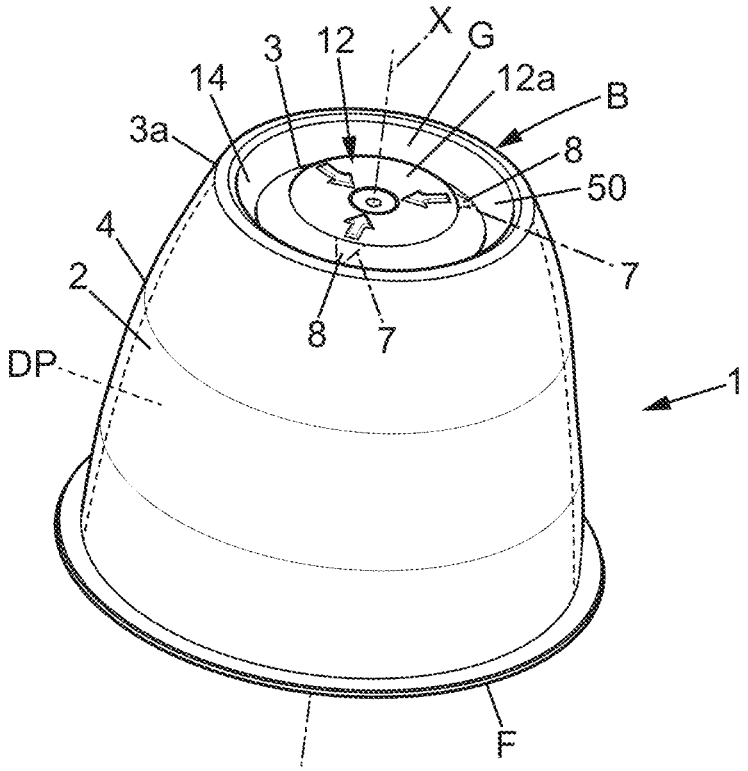
FIG. 1 is a perspective view of a container according to a first embodiment of the invention, in a reverted position adapted for release of the food content.

FIG. 1 shows a container 1 that comprises a hollow body 2 suitable to be filled by food product, typically a solid or semi solid dairy product DP, optionally with an additional layer AL. Such food product defines a molded mass when received in the container 1 and also when released through an opening 5 (discharge opening) of the container 1. The dairy product DP or similar product received in the container 1 is typically cooled (for instance stored in a refrigerator) after its production. A seal membrane 5*a* (see FIG. 8) or similar cover seal can typically seal the container 1 after filling with the food product. Optionally, a lid 11 (FIG. 6) may be used for the sealing or for protecting the seal membrane 5*a*. It is understood that the container 1 is in a reverted position in FIG. 1.

Referring to FIGS. 1-5, the hollow body 2, 102, 202 comprises a bottom 3 and a side wall 4 extending along a longitudinal axis X from the bottom 3 to a top 4*a* surrounding an opening 5. The top 4*a* is here defined by a flange F, preferably a planar flange adapted for supporting a cover seal. The side wall 4 is tightly connected to the bottom 3, so as to define an interior volume V of the container 1. As apparent in particular in FIGS. 1, 4 and 6, the side wall 4 has an internal surface that typically shows a sufficient taper to facilitate release of the product which has been molded in the container 1. The longitudinal axis X may be a central axis, preferably a symmetry axis, for the side wall 4 and the opening 5.

The bottom 3 has an outer edge 3*a* and a non-planar exterior surface S. The hollow body 2, 102, 202 is here a thermoplastic body. Optionally, it is obtained from a plastic sheet, preferably a sheet including a mix of PE (polyethylene) and PP (polypropylene), or using similar stretchable material that can be rolled on a reel. It is understood that the bottom 3 is here defined by a single layer of plastic material and the food product fills a single compartment defined by the (undivided) interior volume V. The side wall 4 may be simple and conventional, without recourse to partitioning wall to define an additional compartment. Spaced frangible connections 7 are provided in the bottom 3. Transparent plastic may be used and a mix PE/PP (for instance with at least 30 wt % for PE, and preferably at least 50 wt %) is particularly suitable to obtain the hollow body 2, 102, 202 with such frangible connections 7, here defined by a local reduction of thickness in the bottom 3. The frangible connections 7 are optionally curved or angled. A V-shape may be provided for these frangible connections 7. But other shapes, in particular L-shape, U-shape, C-shape or J-shape may be used.

The bottom 3 has a configuration adapted for maintaining the container 1 in a more or less vertical position. Here the outer edge 3*a* is part of an annular bearing member B and extends at a free end of the container 1. Such outer edge 3*a* may have a continuously rounded shape or alternative shapes with corners, preferably rounded corners. The bearing means are optionally chosen amongst a plurality of pegs and an annular lower projection. More generally, the bearing means of the container are integral with one of the bottom 3 and the side wall 4. A self standable container 1 is thus formed when the opening 5 is facing upwardly. The bearing means may comprise one ore more protruding bearing members B to prevent contact between wall portions of the bottom 3 provided with the frangible connections 7 and a horizontal planar surface in contact with the bearing members B.

In a preferred option as shown in FIGS. 1-4, the frangible connections 7 extend at opposite short sides of intermediary wall parts 10 that are sloped. It is understood that the frangible connections 7 are here not parallel to the horizontal planar surface in contact with the bearing members B when the container 1 is in a more or less vertical storage position. It can be seen that the frangible connections 7 may be defined between:

a respective one of the intermediary wall parts 10, and a closing member 8, 108.

Here, three frangible connections 7 are provided but their number may be increased. Each closing member 8, 108 tightly joins two adjacent of the intermediary wall parts 10 at the frangible connections 7 and is configured to interact with an actuating member 12 (here a single actuating member). The actuating member 12 comprises an actuation portion 12*a* which is preferably located centrally in the bottom 3 and surrounded by the intermediary wall parts 10.

Figure 2:
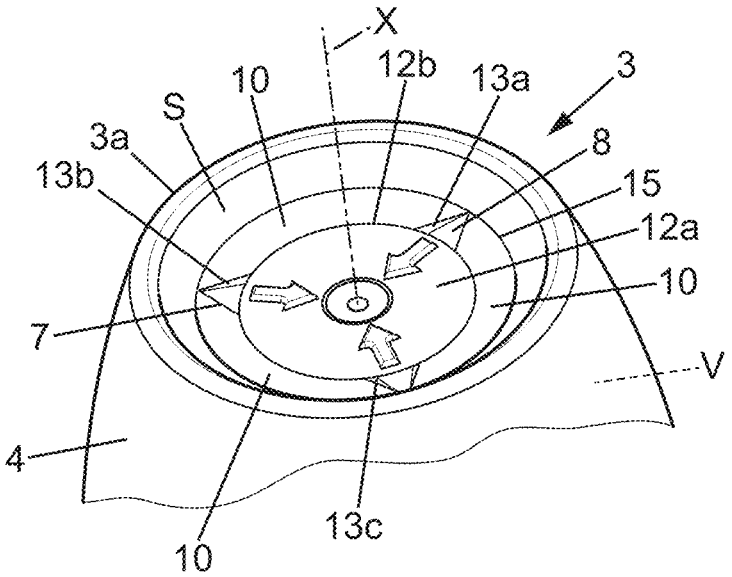
FIG. 2 illustrates the bottom of the container shown in FIG. 1 where the actuating member used to release the food content has been actuated.
Figure 3:
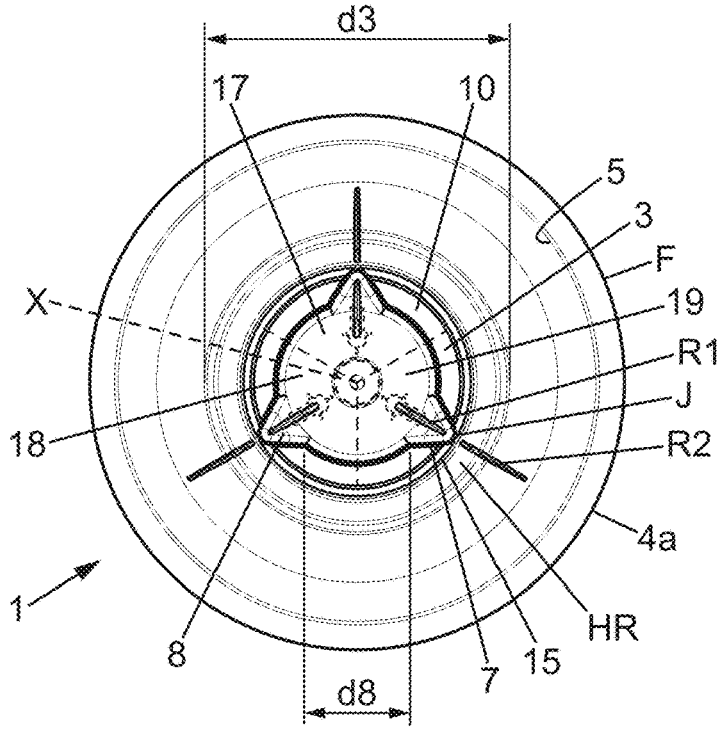
FIG. 3 is a top view of the container of FIG. 1, before filling with food product.

The actuating member 12 is movable relative to the outer edge 3*a* and is configured to actuate simultaneously the relative change of position between the closing members 8, 108 and the plurality of intermediary wall parts 10 of the bottom 3, in order to break each of the frangible connections 7 and form at least three spaced vent holes 13*a*, 13*b*, 13*c* in the bottom 3. As shown in FIGS. 2-3, vent holes 13*a*, 13*b*, 13*c* having a generally triangular shape may be obtained because of the break of the frangible connections 7 in respective distinct regions 17, 18, 19 of the bottom 3. Such shape is here particularly efficient for obtaining simultaneous opening of relatively wide holes by a single actuating member 12. Two adjacent sides of the vent holes 13*a*, 13*b*, 13*c* may each have a length superior or equal to 4 mm in a non-limiting example. It is thus understood that such vent holes 13*a*, 13*b*, 13*c* are more efficient than narrow slits for the air entry through the bottom 3.

It may be advantageous, in some options, to provide one or more bearing members B (preferably of continuously annular shape) that define an internal recess HR to contain a remaining part of the product DP near the side wall and are arranged at lower level than the frangible connections 7. Indeed, after breaking of the frangible connections 7 and release of the product DP, the container 1 may be placed vertically on a support with minimized risk of leakage of the remaining food part through the bottom 3. The remaining food part that is in contact with the side wall 4 can flow toward the internal recess HR and cannot escape through the vent holes 13*a*, 13*b*, 13*c* that here extend radially at a distance from the outer edge 3*a* (i.e. in an inwardly shifted position relative to the peripheral part 14 that comprises the outer edge 3*a* and the bearing member B). Here, the peripheral part 14 may define a continuously annular outer surface 50, not flexible, that extends around a flexible part of the bottom 3.

The regions 17, 18, 19 each provided with one of the vent holes 13*a*, 13*b*, 13*c* may correspond to an angular sector around the longitudinal axis X, as visible in FIG. 3. The vent holes 13*a*, 13*b*, 13*c* may extend at a same longitudinal distance from the free end defined by one ore more bearing member B. As shown in FIGS. 2 and 6 in particular, after actuation of the actuating member 12 to break each of the frangible connections 7, the actuating member 12 preferably extends parallel to a determined virtual plane defined by the opening 5 (corresponding to the plane of the flange F shown in FIGS. 1 & 3-5).

In all the FIGS. 1-7, it can be seen that the frangible connections 7 are distributed to allow formation of distinct air bubbles rather than one single central air bubble. The vent holes 13*a*, 13*b*, 13*c* are each distal from the longitudinal axis X and, preferably, proximal relative to the outer edge 3*a*. At least when the vent holes 13*a*, 13*b*, 13*c* each define an identical or similar section with same spacing relative to the longitudinal axis X, pushing of the dairy product DP (or similar food composition) is performed according to a controlled longitudinal direction and excellent results are obtained for the final shape of the released product.

As shown in FIGS. 3, 4, 5 and 7, it can be observed that the frangible connections 7 used to define the vent holes 13*a*, 13*b*, 13*c* are regularly spaced. Three distinct closing members 8, 108, 208, 308 or more are here provided in the bottom 3. The following relation can be satisfied:

$$\tfrac{1}{5}d8/d3 \leq \tfrac{2}{3}$$

where d3 is a characteristic size of the bottom 3 chosen amongst a diameter and a length, and d8 is the shortest distance between two of the closing members 8, 108, 208, 308.

With such sufficient distance d8, several distinct air bubbles can be formed when breaking the frangible connections 7 and repartition of the vent holes 13*a*, 13*b*, 13*c* is optimal with a sufficient flow of air to obtain quick detachment of the dairy product DP (or the like, possibly with an additional layer AL) that is contained in the container 1. FIG. 3 shows that the container 1 is a single compartment container with preferably symmetry around the longitudinal axis X. The bottom 3 comprises an inner face in contact with the dairy product DP or similar product adapted to be poured as one block through the wide opening 5.

A specific description of first and second embodiments of the invention is now provided with reference to FIGS. 1-4.

In the first and second embodiments shown in FIGS. 1-4, a relative displacement occurs between the closing members 8, 108 and the plurality of intermediary wall parts 10 of the bottom 3 when the actuating member 12 is displaced, here pushed, by a user finger.

Referring to FIG. 2, it can be seen that the plastic actuating member 12, typically integrally molded with the hollow body 2, 102, (or integrally molded with the bottom 3) remains integral with the bottom 3 after actuation to simultaneously create the vent holes 13*a*, 13*b*, 13*c*. More generally, the actuating member 12 essentially comprises the same plastic material as a single layer that defines the bottom 3.

Figure 4:
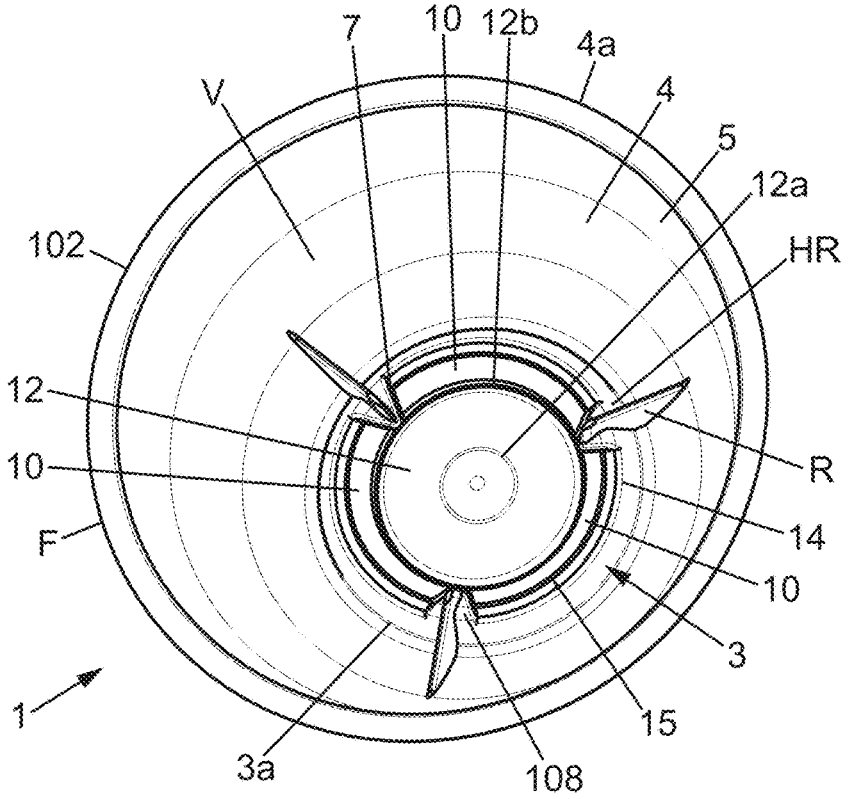
FIG. 4 is perspective view showing a container according to a second embodiment of the invention, before filling with food content.

In the non-actuated state shown in FIG. 1, it can be seen that the outer face of the bottom 3 is provided with an annular groove G that extends (here continuously) between the peripheral part 14 and the actuating member 12. The annular bottom of such groove G may define a hinge 15 allowing displacement of the actuating member 12. In such optional embodiment, the actuating member 12 is connected to the peripheral part 14 by the plastic hinge 15 and configured as a cam to rotate the intermediary wall parts 10. The movement of the actuation portion 12*a* of the actuating member 12 is performed in the general direction of the longitudinal axis X. Referring to FIGS. 3-4, it is understood that the frangible connections 7 may correspond to a local reduction of thickness in the bottom 3 and each separate one of the intermediary wall parts 10 from one of the closing members 8. The hinge 15 is stronger than the frangible connections 7 and configured to limit and stop the stroke of the actuation portion 12*a* of the actuating member 12.

Referring to FIGS. 1-2, the actuation portion 12*a* is here configured as a push button in the bottom 3 and may extend parallel to the opening 5 in the actuated state. The bottom 3 has a dome shape as apparent in FIG. 2 in the actuated position, the actuation portion 12*a* defining an apex of the dome. It can be seen that the vent holes 13*a*, 13*b*, 13*c* are provided in a tapered annular wall part of the dome in this actuated state, preferably at a distance from the outer edge 3*a*.

The intermediary wall parts 10 are sloped as compared to a plane of the bottom 3. As shown in FIG. 2, the intermediary wall parts 10 are sloped inward from the peripheral part 14 in an actuated state of the actuating member 12. The vent holes 13*a*, 13*b*, 13*c* thus guide external air radially outwards when such air enters the interior volume V of the container 1. More generally in the actuated state, the vent holes 13*a*, 13*b*, 13*c* are preferably each configured between two adjacent of the intermediary parts 10 to guide air toward a periphery of the interior volume V. Here, the frangible connections 7 extend in the groove G to intersect the annular hinge 15.

To facilitate exact separation between the intermediary wall parts 10 and the closing elements 8, at least one rib R1 may be used on the inner face of the bottom 3 to reinforce each of the closing elements 8. Other ribs R2 may be provided to reinforce the peripheral part 14, such ribs R2 being useful for stacking of a plurality of containers 1, while maintaining a space between the flanges F of two adjacent containers 1 in the stack.

In the first embodiment shown in FIGS. 1-3, the ribs R1 belong to the actuating member 12 and thus limit deformation of the actuating member 12. The bottom 3 is here provided with at least three closing members 8 defined as rigid protrusions with respect to the actuation portion 12*a*. In other words, each closing member 8 is tab-like radial extension forming part of the actuating member 12. These closing members 8 follow movement of actuation portion 12*a*, while the intermediary wall parts 10 rotate by the hinge effect. With such configuration, a dome shape of the bottom 3 is obtained in the actuated state, without elements protruding outwardly. Each of the frangible connections 7 (typically with a curved or V-shape) is provided with two non parallel portions extending from a common junction J that is part of the hinge 15.

In the second embodiment shown in FIG. 4, ribs R1 and R2 are replaced by a common inner rib R protruding inwardly from the closing element 108 and joining the side wall 4 over the inner face of the peripheral part 14. The bottom 3 is here provided with at least three closing members 108 defined as rigid protrusions fixed relative to the outer edge 3*a* and extending from the peripheral part 14 to an end 8*a* adjacent to the actuating member 12. Such end here corresponds to the junction with an outer rim 12*b* of the actuation portion 12*a*. In the first and second embodiments, this outer rim 12*b* may formed as an annular hinge to facilitate longitudinal movement of the actuating portion 12*a* without significant deformation of the pushed area (as shown in FIG. 2, the actuating portion 12*a* may remain as flat in the actuated state as in the non-actuated state).

The closing members 108 remain as static as the peripheral part 14, not following movement of the actuation portion 12*a*. With such configuration, a dome shape of the bottom 3 is also obtained in the actuated state and the closing elements 108 protrude (externally) around the central pushed area. Such arrangement may be useful to prevent improper pushing action at a distance from the longitudinal axis X since the user feels more rigidity at the location of the closing elements 108 and is thus incited to push at the centre of the actuation portion 12*a*.

According to an option useful with several alternative embodiments for actuating the opening of the vent holes 13*a*, 13*b*, 13*c*, the actuation portion 12*a* has a maximal size (typically a diameter defined by a circular outer rim 12*b*), which is inferior to 30 or 35 mm. Such size, which remains superior to about 15 or 20 mm, is well adapted to define an efficient push button or push area and prevent incomplete break of all the frangible connections 7. It is understood that the longitudinal axis X intersects the actuation portion 12*a* and the vent holes 13*a*, 13*b*, 13*c* are all laterally shifted with respect to the actuation portion 12*a*. Indeed, the actuating member 12 is arranged distal from the side wall 4, while the closing members 8, 108 are preferably located in an annular region of the bottom 3 surrounding a central region of the bottom 3. Such distribution may also apply for closing members 208, 308 of other embodiments.

Figure 5:
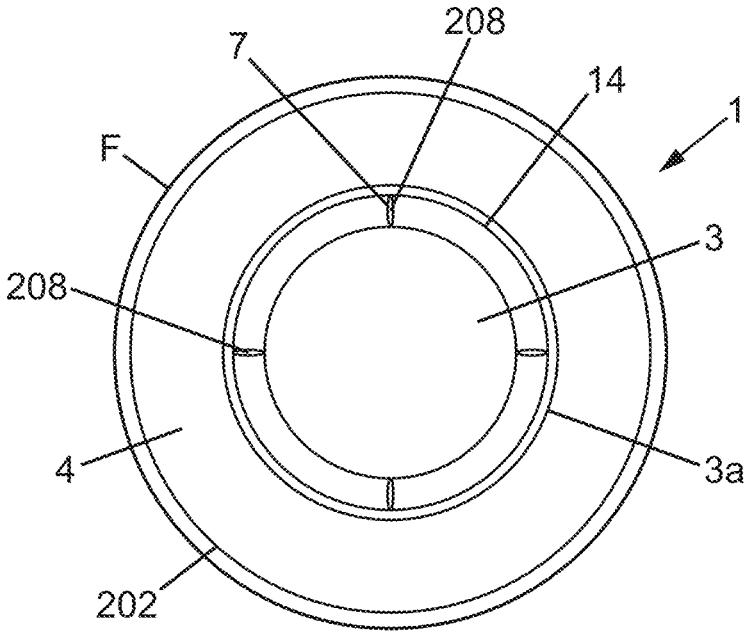
FIGS. 5 and 6 are bottom view and side view, respectively, of a container according to a third embodiment of the invention.
Figure 6:
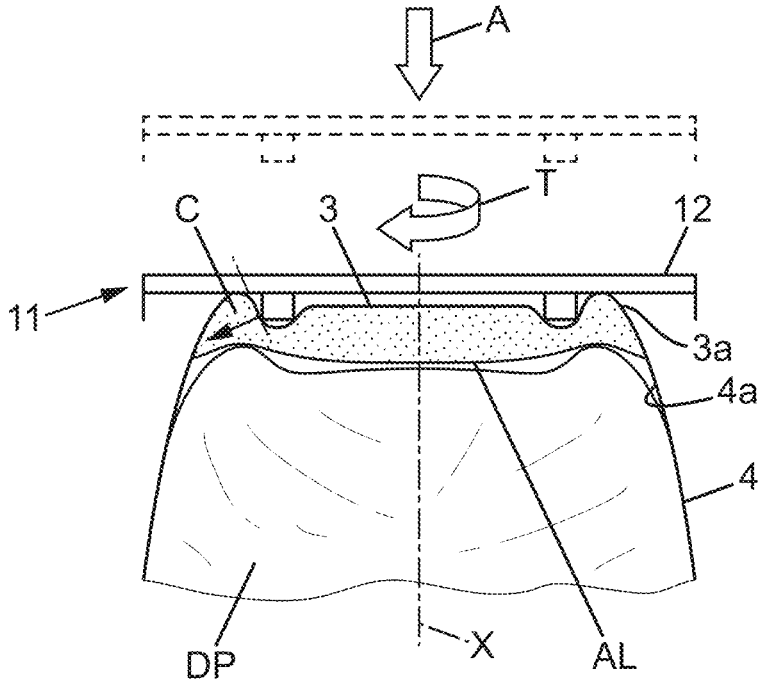

Now referring to FIGS. 5-6 (third embodiment), the actuating member 12 is defined by a closure lid 11 that is used to cover the flange F of the container 1. The body 202 is similar to the body 2 as described in the preceding embodiments but the bottom 3 here comprises closing elements 208 that are connected (typically rigidly connected) to the bottom outer face.

Notches or sharp edges may be formed on the bottom 3, in order to define the closing elements 8. Here, the closing elements 8 extend as protrusions protruding from the bottom outer face. Optionally, a cutting tooling may be used to define the frangible connections 7 at a junction between the closing elements 8 and the bottom outer face. According to an option, the actuating member 12 comprises a plurality of piercing elements according to a same distribution as the frangible connections 7 and the actuating member 12 is movable relative to the outer edge 3*a* to simultaneously break the frangible connections 7 by the piercing elements.

As shown in FIG. 6, the actuating member 12 may be engaged against the bottom outer face by a preliminary approach movement (arrow A) and then rotated (arrow T) to engage and cause rupture of the frangible connections 7. Here, four vent holes are simultaneously defined when the four closing members 208 are displaced (for example with a piercing at a base thereof) by the actuating member 12.

Figure 7:
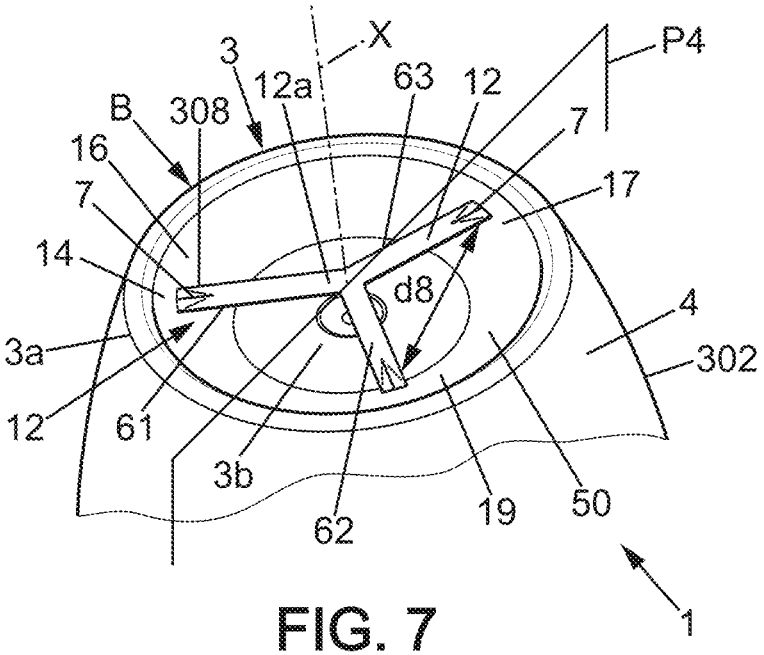
FIG. 7 is perspective view showing a bottom of a container according to fourth embodiment of the invention.

Referring to FIG. 7, another embodiment is provided for actuation, in which the actuating member 12 comprises at least three arms 61, 62, 63 connected to a peripheral part 14 and extending from a central actuation portion 12*a*. At the junction with the peripheral part 14, frangible connections 7 are defined. It is understood that each closing member 308 is here defined by the outer end or other suitable portion of the respective arms 61, 62, 63. Such frangible connections 7 may comprise notches or similar cuts by a cutting tool or can be defined by a reduction of thickness directly obtained through by molding operations. It is understood that each of the vent holes, which are obtained after rupture of the frangible connections 7, are laterally shifted relative to the longitudinal axis X.

Here, the hollow body 302 comprises a bottom 3 having a circular outer edge 3*a*. The annular bearing member B extends around a cavity that contains the actuating member 12. An axial space is provided between the central actuation portion 12*a* and a central portion 3*b* of the bottom 3*a*. The user can push or alternatively pull the central actuation portion 12*a* to obtain simultaneous break of the frangible connections 7, thus defining a corresponding plurality of vent holes (three vent holes in this non-limiting illustrated example).

As in the preceding embodiments, it can be seen that the frangible connections 7 are unaligned, and preferably regularly distributed. Three regions 16, 17, 18, defining angular sectors of the bottom 3, can be observed and are distributed around the longitudinal axis X of the container 1. A higher number of such regions may be provided in alternative options.

There exits for the side wall 4 at least one virtual median plane P4 that intersects the bottom 3 between two bottom halves. After the actuation, the vent holes are distributed in these two bottom halves, at a distance from the virtual median plane P4 (that here contains the longitudinal axis X). The actuating member 12 may be reinforced by one ore more ribs and arms 61, 62, 63 are of higher strength than the frangible connections 7.

In the fourth embodiment as illustrated in FIG. 7, the actuating member 12 may be obtained by overmolding or may be attached by heat sealing or other similar fixation method for plastic material.

A process of making a packaging that includes the container 1, a closing system and the food content is now described referring to FIGS. 1-3 and 8-9.

A filling step is performed with a pouring of the food product inside a container 1 such as above described, through the opening 5. Here, the food product entirely extends in a single compartment defined by the container 1. When several layers are used to define the food product, the layers are successively filed. When the food product consists in a mixture of at least two compositions, the filling of each container 1 may include one or more steps, possibly with more than one injection outlet when two or more compositions are mixed. It is understood that the bottom 3 is in direct contact with the food product, in particular the composition that has been firstly received in the container 1.

Optionally when a firm part M, M' of the food product comprises milk, fermentation is allowed in the container 1. The milk is fermented by the lactic acid bacteria, typically to a final pH lower than setting pH. A set fermented dairy composition thus can be obtained, defining a firm part M, M' of the food product.

After the filling, and provided that the food product is in a molded state in the container 1, the food product is recovered. Alternatively when fermentation occurs, a sealing for recovering the food product can be performed before the firm part M of the food product is in a definitive set state. The container 1 is sealed, possibly by fixing a seal membrane 5*a* onto the upper face of a flange F or similar annular top of the container 1. A flexible film, possibly comprising one or more metallised layers, can form part of the seal membrane 5*a* which provides per se the lid function, without any additional rigid cover. Alternatively, a rigid closure lid 11 may be used (either to cover the membrane seal 5*a*, or to directly seal the container 1). The closure lid 11 may be for instance comprises a hard plastic cover.

In a non-limiting manner, the containers 1 can be used for 50-500 g capacity, preferably 75-200 g capacity.

The containers 1 typically contain a product to be released from the container 1 upon actuation. This releasing operation is also referred to as unmolding. The product is typically an edible product, also referred to herein as "food content". The product has typically a volume of from 80% to 100% of the container capacity.

The food content released using the container 1 is now described with reference to FIGS. 8-9.

The product comprises at least one part that is firm M, M', and optionally another part that is not firm 30, 31, referred to as "non-firm". The firm product or part M, M' typically is in contact with the container 1, and has shape at least partly corresponding to the shape of the container 1. Herein a "firm" product or part M, M' refers to a solid or semi-solid product or part that would retain a shape after unmolding, after 5 minutes at room temperature, preferably 20° C., preferably with a shape corresponding to the shape of the container 1. In a preferred embodiment the firm part M, M' has between 20 to 60 g of texture (typically measured with a TaXT2 texture analyzer with the following settings: Speed before analysis: 0.5 mm/s; Speed during analysis: 1 mm/s; Speed after analysis: 10 mm/s; Length: 4 mm; Time: 30 s; Strength mini: 0.5 g), at temperature of use or at 10° C.

The product might comprise at least one part that is not firm 30, 31. Herein a "not firm" or "non firm" product or part refers to fluid or semi-fluid product or part that would flow after 5 minutes at room temperature, preferably 20° C.

When another part (preferably a flowable part as above defined) distinct from the firm part M, M' is provided, the firm part M, M' is preferably present in an amount of 70 to 99% by weight approximately, preferably between 80 and 98%. The other part may thus be present in a proportion of 1 to 30% by weight.

Figure 9:
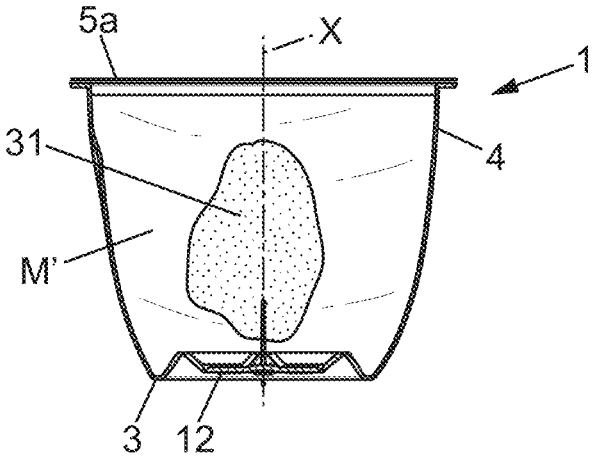
FIG. 9 is an axial cut view showing a firm part of the food content in contact with the container.

In one embodiment as illustrated in FIG. 9, the product comprises a firm part M', with an inclusion of a non-firm part 31 in the firm part M'. In such an embodiment the non-firm part 31 is completely surrounded by the firm part M', and has no contact with the container 1.

In one embodiment the product comprises a firm part M and at least one not firm part that are arranged in layers. Preferably, the non-firm part (typically a topping 30) is in contact with the bottom 3 before the pushing and deformation of the actuation portion 12*a*. In other words, the non-firm part is a layer at the bottom of the container 1, that would form a top part upon unmolding (defining the topping 30 as illustrated in FIG. 8), while the firm part M is a layer above the bottom layer (which thus can be adjacent to the sealed opening 5), that would form a lower part M upon unmolding. As illustrated in FIG. 8, a support plate 34 or the like may be conventionally provided for contact with the wider part defined by the firm part M (lower part upon unmolding). In a preferred embodiment at least some of the top part will flow on the firm part M after unmolding. The firm layer can for example represent from 60 to 95% of the total volume of the product. The not firm layer can for example represent form 5% to 40% to the total volume of the product. Here, the firm part M is entirely covered by the topping 30 so as not to be in contact with the bottom 3 but options with partial covering may also be used.

The firm part M, M' can typically be a milk-based firm product, comprising milk or reconstituted milk and gelling agent. Examples of firm products M, M' include, custards, gelled yogurts, gelled cheeses, puddings, flans etc . . . . Such examples are non limiting and, for instance, a firm part can be obtained using soy yogurt. It is understood that the firm part M, M' is not fragmented and, preferably, only one firm part M, M' is received in the container 1, especially when the food product is layered.

The non-firm part 30, 31 can be sauce, for example a chocolate, coffee or caramel sauce or a fruit preparation, for example a coulis or a jam. In a preferred embodiment the fruit preparation has a fluidity of 3 & 15 cm/min as a determined by cenco analysis, at temperature of use or at 10° C. In a preferred embodiment the non-firm part has a viscosity of from 1 to 1000 mPa·s, preferably from 1 to 500 mPa·s, at a shear rate of 64 $s^{-1}$, at temperature of use or at 10° C.

Figure 8:
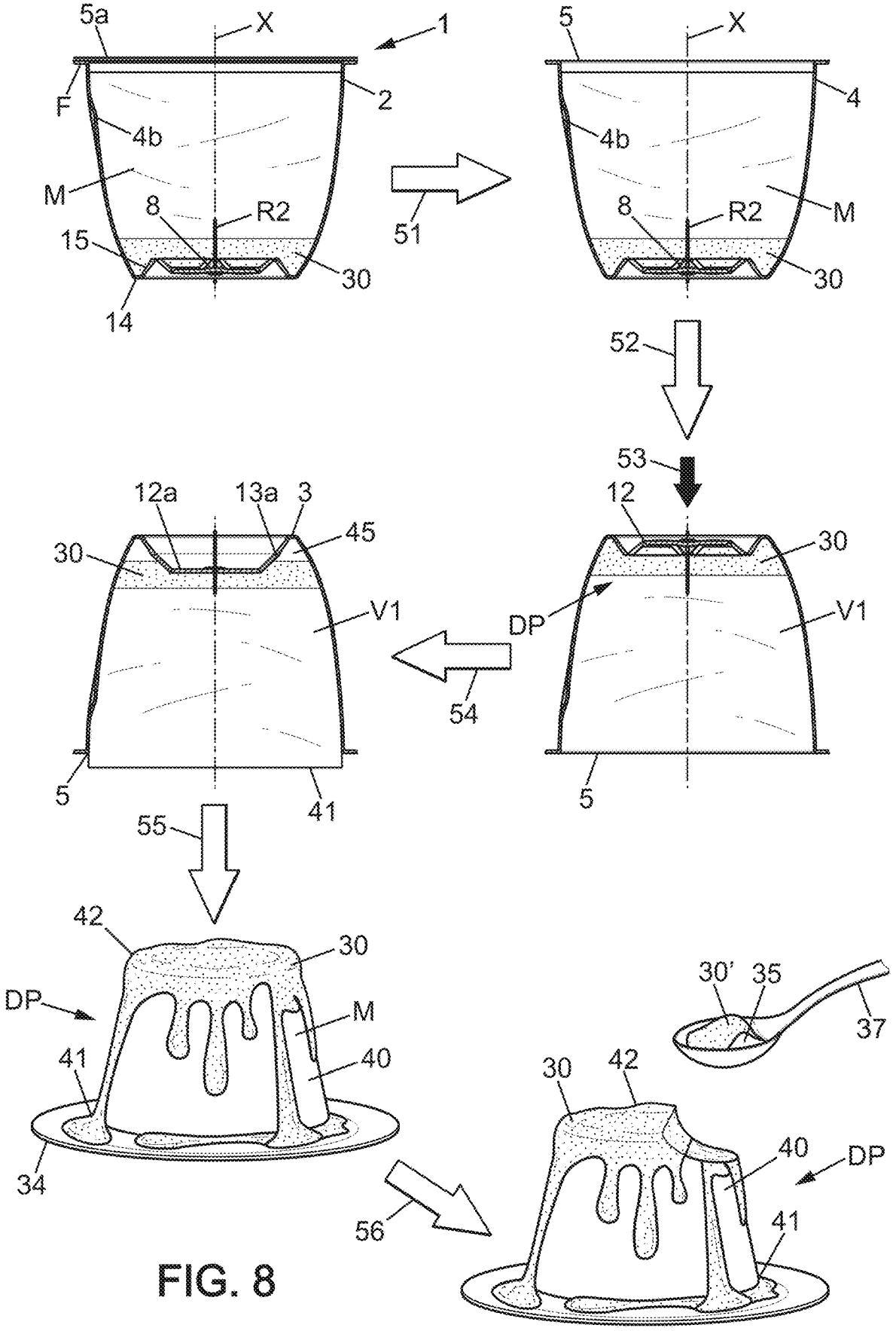
FIG. 8 is a diagram illustrating steps that may be carried out, in order to correctly release the food content.

Release of the food content is illustrated in FIG. 8. The release and usage of the open container 1 are typically performed at room temperature or at storage temperature. It can be seen that the container 1 is in a reverted position after two preliminary steps 51, 52 consisting, respectively, of removing the seal 5*a* and inverting the container 1 filled with the product. In this non-limiting example, the food product comprises a not firm part to define a topping 30, in contact with the bottom 3. The firm part M extends between the topping 30 and the opening 5.

The actuating member 12, for instance a push member, is then actuated in an actuation step 54. In the illustrated example, a substantially vertical pressure is exerted downwardly as indicated by the black arrow 53. After the release, the peripheral part 40 of the firm part M extends from a wider part 41 in contact with the support plate 34 to a narrow part 42. The topping 30, which is optionally a flowable product, may at least partly cover a peripheral face 40 of the firm part M after the release from the container 1.

More generally, it is understood that the actuation step 54 is immediately followed by a substitution step 55, in which the molded food product received in the container 1 (here a single compartment container) is replaced by air 45 entering through the spaced vent holes 13*a*, 13*b*, 13*c*. With such substitution step 55, and because the actuating member 12 has been displaced longitudinally in a same direction/orientation as effect of gravity, the firm part M keeps its integrity and is discharged as one single block through the opening 5. Increase of pressure in this part of the container 1 (at the end of the food content, which is here narrower than the wider part 41) has an auxiliary push effect. After the actuation step 54, the molded food product is replaced by air 45 entering inside the container 1 without any additional user action. Preferably, air enters through the spaced vent holes 13*a*, 13*b*, 13*c* that extend between the central actuation portion 12*a* and the hinge 15 (as shown in FIG. 2). Accordingly, air 45 firstly enters around a central area of the narrow part of the molded food product.

It is understood that the volume V1 of the firm part M is substantially unchanged before and after the release (same molded shape). The firm part M has here a significantly greater volume V1 as compared to the volume of the non firm part. Referring to the example of FIG. 8, the topping 30 can flow along the peripheral face 40 without modifying the overall shape (as perceived by the user) of the food content. Use of spaced vent holes 13*a*, 13*b*, 13*c*, here regularly spaced around the actuating member 12, prevents air from accumulating on only one side of the food product.

Typically, a user will start eating the food by extracting a first piece of product 35 (at step 56, using a spoon 37 or similar utensil) that belongs to the top of the firm part M. Such first piece of product 35 thus may comprise a part 30' of the topping 30 stored at the top Then, the topping reservoir initially defined at the top is emptied by an additional downward sliding of the flowable compound or mixture used to define the topping 30

Of course, geometry of the bottom 3 and distribution of the vent holes 13*a*, 13*b*, 13*c* may vary to obtain the same substitution effect with air replacing the food content without undesirable tilting effect. For instance, the embodiment illustrated in FIGS. 5-6 is also suitable to obtain the steps 54, 55 and 56. In such alternatives, the narrow part of the molded food product may be flat (without concavity, groove, indentation or similar hollow) or may include a hollow that is not caused by a pushing action on the bottom 3.

Referring to FIG. 9, it can be seen that another kind of reservoir may be defined when the non firm part 31 is internally arranged in the firm part M'.

When the food content is a dairy product or other temperature sensitive edible product, the container 1 filled with the food content and sealed with a rigid cover and/or flexible seal membrane 5*a* is preferably stored in a cooled state. Storage at chilled 1-10° C. temperature is typically used. Alternatively for some compositions and/or depending on the intended use (fast consumption expected for instance), storage at room temperature is sufficient.

Of course, the containers 1 of the present invention are not in any way limited to custard products and yoghurt having a firm texture but can be intended to contain all sorts of solid and semi-solid products.

The present invention has been described in connection with the preferred embodiments. These embodiments, however, are merely for example and the invention is not restricted thereto. Although the Figures show a body 2, 102, 202, 302 having a circular cross-section and a circular opening 5, other shapes may be used, for instance a rectangular shape with rounded corners or an oval shape.

It will be understood by those skilled in the art that other variations and modifications can easily be made within the scope of the invention as defined by the appended claims, thus it is only intended that the present invention be limited by the following claims.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

The invention claimed is:

1. A plastic container for a molded food product, comprising a body having a cup-shape, the body comprising:
- a bottom;
- a side wall connected to the bottom, so as to define an interior volume of the plastic container,
- an opening at an opposite side from the bottom,
- and the bottom including
  - an outer edge, and
  - frangible connections, distributed so that the bottom comprises at least three distinct regions each comprising at least one of the frangible connections; and
- a plastic actuating member that is movable relative to the outer edge and is configured to actuate a simultaneous break of each of the frangible connections and form at least three spaced vent holes in the bottom,
- wherein the bottom further includes
  - closing members,
  - a peripheral part that comprises said outer edge, and intermediary wall parts joining the peripheral part,
- wherein the frangible connections each separate one of the closing members from one of the intermediary wall parts,
- wherein the plastic actuating member is configured to actuate simultaneously a relative change of position between the closing members and the intermediary wall parts of the bottom, whereby the simultaneous break of each of the frangible connections is obtained, and
- wherein the plastic actuating member includes
  - an actuation portion, and
  - the closing members defined as rigid protrusions with respect to the actuation portion.

2. The container according to claim 1, wherein the plastic actuating member is an integral part of the bottom and is surrounded by the intermediary wall parts.

3. The container according to claim 1,
- wherein the intermediary wall parts are sloped inward from the peripheral part in an actuated state of the plastic actuating member, and
- wherein the at least three spaced vent holes are each disposed between two adjacent of the intermediary parts to guide air toward a periphery of the interior volume.

4. The container according to claim 1, wherein at least three of the closing members are provided in the bottom.

5. The container according to claim 1, wherein the outer edge extends at a free end of the container, the bottom comprises an annular groove defined between the outer edge and the plastic actuating member, and the frangible connections extend in the annular groove.

6. The container according to claim 1, wherein the frangible connections are curved or angled, and provided with one of a V-shape, a L-shape, a U-shape, a C-shape and a J-shape.

7. The container according to claim 1, wherein the interior volume is a single filling volume, the plastic container containing a molded mass of a solid or semi solid dairy product in the interior volume when the opening is closed.

8. The container according to claim 1, wherein the plastic actuating member is integral with the bottom or irremovably attached to the bottom after actuation of the plastic actuating member.

9. A plastic container for a molded food product, comprising a body having a cup-shape, the body comprising:
- a bottom;
- a side wall connected to the bottom, so as to define an interior volume of the plastic container,
- an opening at an opposite side from the bottom,
- and the bottom including
  - an outer edge, and
  - frangible connections, distributed so that the bottom comprises at least three distinct regions each comprising at least one of the frangible connections; and
- a plastic actuating member that is movable relative to the outer edge and is configured to actuate a simultaneous break of each of the frangible connections and form at least three spaced vent holes in the bottom,
- wherein the bottom further includes
  - closing members,
  - a peripheral part that comprises said outer edge, and intermediary wall parts joining the peripheral part,
- wherein the frangible connections each separate one of the closing members from one of the intermediary wall parts,
- wherein the plastic actuating member is configured to actuate simultaneously a relative change of position between the closing members and the intermediary wall parts of the bottom, whereby the simultaneous break of each of the frangible connections is obtained, and
- wherein the closing members are rigid protrusions fixed relative to the outer edge and extending from the peripheral part to an end adjacent to the plastic actuating member.

10. The container according to claim 9, wherein the plastic actuating member is an integral part of the bottom and is surrounded by the intermediary wall parts.

11. The container according to claim 9,
- wherein the intermediary wall parts are sloped inward from the peripheral part in an actuated state of the plastic actuating member, and
- wherein the at least three spaced vent holes are each disposed between two adjacent ones of said intermediary wall parts to guide air toward a periphery of the interior volume.

12. The container according to claim 9, wherein at least three of the closing members are provided in the bottom.

13. The container according to claim 9, wherein the plastic actuating member is integral with the bottom or irremovably attached to the bottom after actuation of the plastic actuating member.

14. The container according to claim 9, wherein the outer edge extends at a free end of the plastic container, the bottom comprises an annular groove defined between the outer edge and the plastic actuating member, and the frangible connections extend in the annular groove.

15. The container according to claim 9, wherein the frangible connections are curved or angled, and provided with one of a V-shape, a L-shape, a U-shape, a C-shape and a J-shape.

16. A plastic container for a molded food product, comprising a body having a cup-shape, the body comprising:

a bottom;

a side wall connected to the bottom, so as to define an interior volume of the plastic container, an opening at an opposite side from the bottom, and the bottom including an outer edge, and frangible connections, distributed so that the bottom comprises at least three distinct regions each comprising at least one of the frangible connections; and a plastic actuating member that is movable relative to the outer edge and is configured to actuate a simultaneous break of each of the frangible connections and form at least three spaced vent holes in the bottom, wherein the bottom further includes closing members, a peripheral part that comprises said outer edge, and intermediary wall parts joining the peripheral part, wherein the frangible connections each separate one of the closing members from one of the intermediary wall parts, wherein the plastic actuating member is configured to actuate simultaneously a relative change of position between the closing members and the intermediary wall parts of the bottom, whereby the simultaneous break of each of the frangible connections is obtained, wherein the plastic actuating member provided with an actuation portion is connected to the peripheral part by a plastic hinge and configured as a cam to rotate the intermediary wall parts by a movement of the actuation portion along a longitudinal axis of the container.

17. A plastic container for a molded food product, comprising a body having a cup-shape, the body comprising:

a bottom;

a side wall connected to the bottom, so as to define an interior volume of the plastic container, an opening at an opposite side from the bottom, and the bottom including an outer edge, and frangible connections, distributed so that the bottom comprises at least three distinct regions each comprising at least one of the frangible connections; and a plastic actuating member that is movable relative to the outer edge and is configured to actuate a simultaneous break of each of the frangible connections and form at least three spaced vent holes in the bottom, wherein the bottom further includes closing members, a peripheral part that comprises said outer edge, and intermediary wall parts joining the peripheral part, wherein the frangible connections each separate one of the closing members from one of the intermediary wall parts, wherein the plastic actuating member is configured to actuate simultaneously a relative change of position between the closing members and the intermediary wall parts of the bottom, whereby the simultaneous break of each of the frangible connections is obtained, wherein the plastic actuating member comprises an actuation portion configured as a push button in the bottom and the bottom is dome-shaped in an actuated position of the plastic actuating member, and wherein in said actuated position, the actuation portion defines an apex of the dome-shaped bottom, while the at least three spaced vent holes are provided in a tapered annular wall part of the dome-shaped bottom.

18. A plastic container for a molded food product, comprising a body having a cup-shape, the body comprising:

a bottom;

a side wall connected to the bottom, so as to define an interior volume of the plastic container, an opening at an opposite side from the bottom, and the bottom including an outer edge, and frangible connections, distributed so that the bottom comprises at least three distinct regions each comprising at least one of the frangible connections; and a plastic actuating member that is movable relative to the outer edge and is configured to actuate a simultaneous break of each of the frangible connections and form at least three spaced vent holes in the bottom, wherein the plastic actuating member comprises a plurality of piercing elements distributed according to a same distribution as the frangible connections, and the plastic actuating member is movable relative to the outer edge in order to simultaneously break the frangible connections by way of the plurality of piercing elements.

* * * * *